US005448115A

United States Patent [19]

Howland et al.

[11] Patent Number: 5,448,115

[45] Date of Patent: Sep. 5, 1995

[54] WAREWASHING CONTROL SYSTEM AND METHOD OF OPERATION

[75] Inventors: David R. Howland; Francis Turner, both of Aptos, Calif.

[73] Assignee: Nova Controls, Santa Cruz, Calif.

[21] Appl. No.: 929,179

[22] Filed: Aug. 12, 1992

[51] Int. Cl.[6] ..... A47L 15/44

[52] U.S. Cl. ..... 307/118; 134/58 D; 134/113; 134/57 D

[58] Field of Search ..... 134/57 D, 56 D, 58 D, 134/113; 307/118, 116, 125

[56] References Cited

U.S. PATENT DOCUMENTS

| | | | |
|---|---|---|---|
| 3,445,038 | 5/1969 | Booth et al. | 222/56 |
| 3,680,784 | 8/1972 | Fakes | 239/126 |
| 3,771,333 | 11/1973 | Jurjans | 68/12 R |
| 3,903,909 | 9/1975 | Noren et al. | 134/58 D |
| 3,982,666 | 9/1976 | Kleimola et al. | 222/70 |
| 4,147,559 | 4/1979 | Fraula et al. | 134/57 D |
| 4,211,517 | 7/1980 | Schmid | 417/12 |
| 4,249,573 | 2/1981 | Chevallier | 137/624.2 |
| 4,285,352 | 8/1981 | McMahon et al. | 134/48 |
| 4,481,786 | 11/1984 | Bashark | 62/160 |
| 4,509,543 | 4/1985 | Livingston et al. | 134/57 D |
| 4,756,321 | 7/1988 | Livingston et al. | 134/56 D |
| 4,832,064 | 5/1989 | Nezworski | 134/44 |
| 5,056,542 | 10/1991 | Reinhard | 134/57 D |

OTHER PUBLICATIONS

Knight Equipment Corp. Advertising Brochure, "Probeless Microprocessor Warewashing Control," Dec. 1987.

Knight Equipment Corp. Instruction Manual, "KPL-652M Probeless Warewashing System," Dec. 1987.

*Primary Examiner*—Steven L. Stephan
*Assistant Examiner*—Aditya Krishnan
*Attorney, Agent, or Firm*—Townsend and Townsend Khourie and Crew

[57] ABSTRACT

Improved timing circuits (205), charge dispensing circuits (213,215), and methods and systems (100) for operation of warewashing equipment. According to one aspect of the invention the system operates on both door and conveyor types of machines. The system dispenses both an initial charge amount and a dose amount during normal operations. In door types of systems, only a single power/signal connection (109) needs to be made to the dispensing system; in one embodiment the warewash rinse power connection. Further, the system can dispense detergent at an interval of greater than once per cycle or operation.

18 Claims, 12 Drawing Sheets

WAREWASHING CONTROL SYSTEM AND METHOD OF OPERATION

COPYRIGHT NOTICE

A portion of this disclosure contains material that is subject to copyright protection. The copyright owner has no objection to the facsimile reproduction by anyone of the patent document or the patent disclosure exactly as it appears in the Patent and Trademark Office patent file or records, but otherwise reserves all copyright rights whatsoever.

BACKGROUND OF THE INVENTION

The present invention relates to the field of timing circuits and methods of operation of timing systems. In one embodiment the invention provides an improved method and device for generation of appropriate control signals for dispensing cleaning materials and other materials into warewashing machines.

Warewashing machines are well known to those of skill in the art and widely used in a variety of industries. Most commonly such devices take the form of commercial dishwashing machines and the like. Among warewashing machines, door loading and conveyor type machines are most common. Door loading machines operate on a "batch" basis in which articles are loaded into the machine, the articles are placed through various cycles such as wash, rinse, and the like, and the articles are removed. In conveyor type machines, articles are placed in one end of the machine, passed through the device, and subjected to various operations based on their location in the device.

To conserve significant amounts of water and other resources in such systems, they often reuse wash water and the detergents contained therein during a wash cycle. Fresh water is imported to the device during a rinse cycle to remove soap and other remnants of a wash cycle from articles in the warewashing machine. This rinse water then supplements the previously used wash water, and a portion of the previously used wash water is removed from the machine. Accordingly, such systems continuously import fresh water to prevent problems associated with excessive reuse of the wash water.

While meeting with substantial success, such systems have also met with certain limitations. Importantly, the addition of rinse water to the wash water results in dilution of the detergent and other desirable materials in the wash water. Further, the amount (or "charge") of detergent or other material that is added after each rinse cycle varies substantially from the amount that is to be added when a warewasher is initially started.

In the past, a variety of solutions have been proposed to the above problems. Commonly, such devices use of various chemical sensors such as conductivity probes. When the concentration of the wash water reaches predetermined limits, such devices then dispense additional detergent. Such systems have the disadvantage of requiring expensive, high maintenance chemical probes, which are prone to failure particularly in hard water operation.

Certain control systems for warewashing machines base detergent charge timing on the status of the machine. For example, certain control systems have dispensed materials when the device is in a rinse cycle. However, such devices have also met with certain limitations. For example, the devices tend to be complex to install as a result of the many electrical interfaces with the warewashing device. Further, such control systems are prone to difficulty when the power to the warewashing machine is cut-off since the device does not "recall" when the last detergent charge has taken place. Such devices have experienced further difficulty because they tend to be failure prone, complex to set-up, and the like.

From the above it is seen that an improved control system for warewashing equipment and systems, is needed.

SUMMARY OF THE INVENTION

Improved timing circuits, charge dispensing circuits, and methods and devices for operation and control of warewashing equipment are provided by virtue of the present invention.

According to one aspect of the invention the system can be used on both door and conveyor types of machines. The system dispenses both an initial charge amount and a dose amount during normal operations. In door types of systems, only a single power/signal connection needs to be made between the control device and the warewashing machine; that is, the warewash rinse power connection. Further, the system can dispense detergent at an interval of greater than once per cycle or operation.

An improved electronic timing adjustment system is also disclosed that can be used in, for example, shot timers, delays on operation, delays on release, and the like. In the particular embodiment disclosed herein, dose amounts are set with the timing system. The operator "hunts" for a turn-off point through adjustment of a potentiometer, but the adjustment itself does not change the rate of change of the timing network. According to one example, the system provides for the user to simply turn the potentiometer back such that the system deactivates when the desired time has elapsed, setting the circuit for the desired time.

Accordingly, in one embodiment the invention includes a detergent supply control system comprising including rinse power detection means, the rinse power detection means providing power to the control system and coupled to non-volatile integration means, the integration means adapted to generate a signal for dispensing a detergent dose when the integration means reaches a selected limit.

A further understanding of the nature and advantages of the inventions herein may be realized by reference to the remaining portions of the specification and the attached drawings.

DESCRIPTION OF THE PREFERRED EMBODIMENTS

Contents

I. General
II. Timing Adjustment Circuit
III. Digital Memory
IV. Installation/Operation I. General The device described herein provides a control system for feeding detergent and/or other materials to a warewasher in an amount related to the number of rinse cycles or the amount of rinsewater supplied to the device. The device is probeless, providing low cost and higher reliability. The device is also easily installed, adjusted, and operated.

Figure 1A:
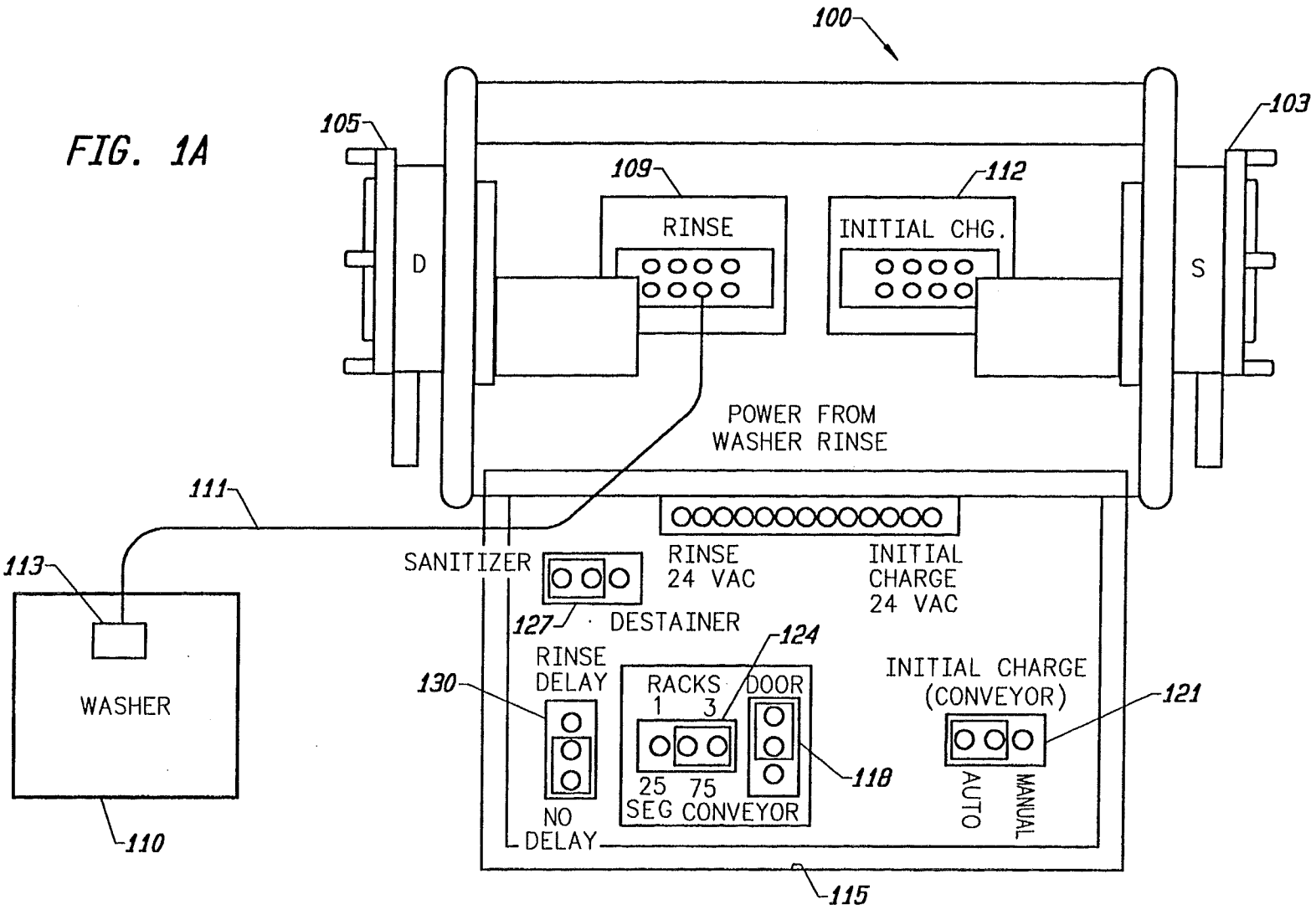
FIGS. 1A and 1B provide mechanical illustrations of the exterior of the control system disclosed herein.
Figure 1B:
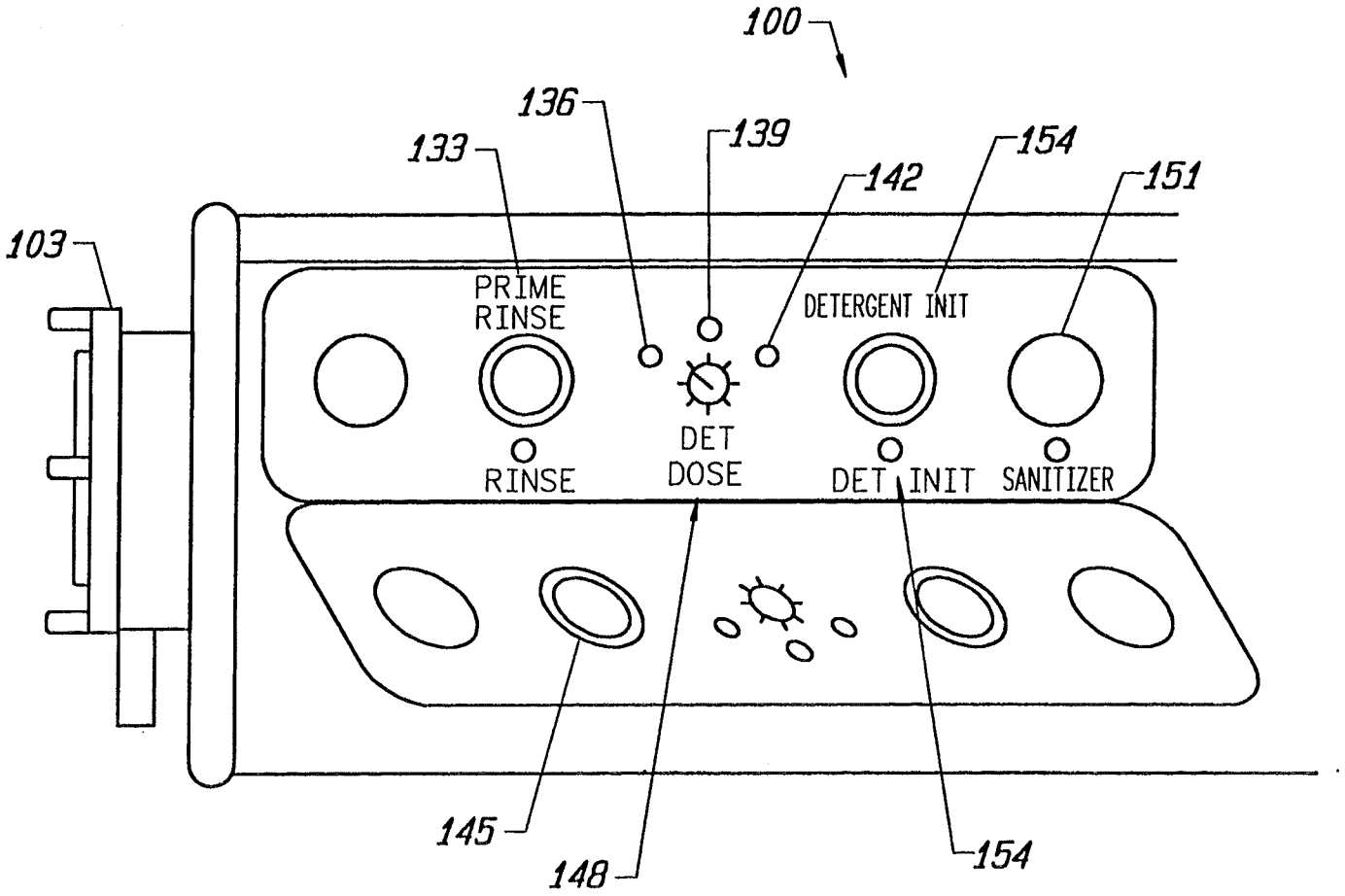

FIGS. 1A and 1B illustrate mechanical features of a control system 100. FIG. 1A illustrates a back view of the device and FIG. 1B illustrates a front view of the device. As shown therein, the system controls operation of a rinse pump 103 for pumping material such as rinse additive, and a second, detergent pump 105. A third, optional pump (not shown) may also be operated under direction of the control system for addition of either sanitizer or destainer (not shown).

For door type washers, the system preferably receives power/operational signals only via rinse power receptacle 109 that is attached to rinse power in a warewasher 110, such as the power leading 111 to a solenoid 113 that opens a valve that allows rinse water into the system. In the case of conveyor type systems, the system also receives input via an initial power receptacle 112. Power signals to receptacle 112 may be provided in some embodiments from a washer heater power supply or other power supply that is on continuously when the warewasher is in operation. In each case, various input points are provided for differing input voltage levels such as 240, 208, or 110 vac. In certain embodiments the device may dispense three products, in which case detergent is dispensed via the use of a solenoid valve, pump 105 is used for dispensing destainer while pump 103 is used to dispense sanitizer.

A PCB 115 is provided with various jumpers to adjust the operation of the device. In particular, the device includes a jumper 118 that sets the device for door or conveyor operation, a jumper 121 to set the device for manual or automatic initial charge, a jumper 124 to set the device for a number of racks in the door mode or the number of seconds that have passed since the last charge in the conveyor mode, a jumper 127 to set the device for dispensing sanitizer or destainer, and a jumper 130 to set the device for delay or no delay in rinse dispensing operation.

The front of the device (shown in FIG. 1B) includes a button 133 to run a rinse prime, a light 136 to indicate rinse flow, a light 139 to indicate recharge flow, a light 142 to indicate initial charge flow. The device further includes a control knob 145 to adjust rinse flow, a knob 148 to adjust the detergent recharge dose, and a knob 151 to adjust sanitizer/destainer flow. Button 154 is used to set initial charge volume.

Figure 3:
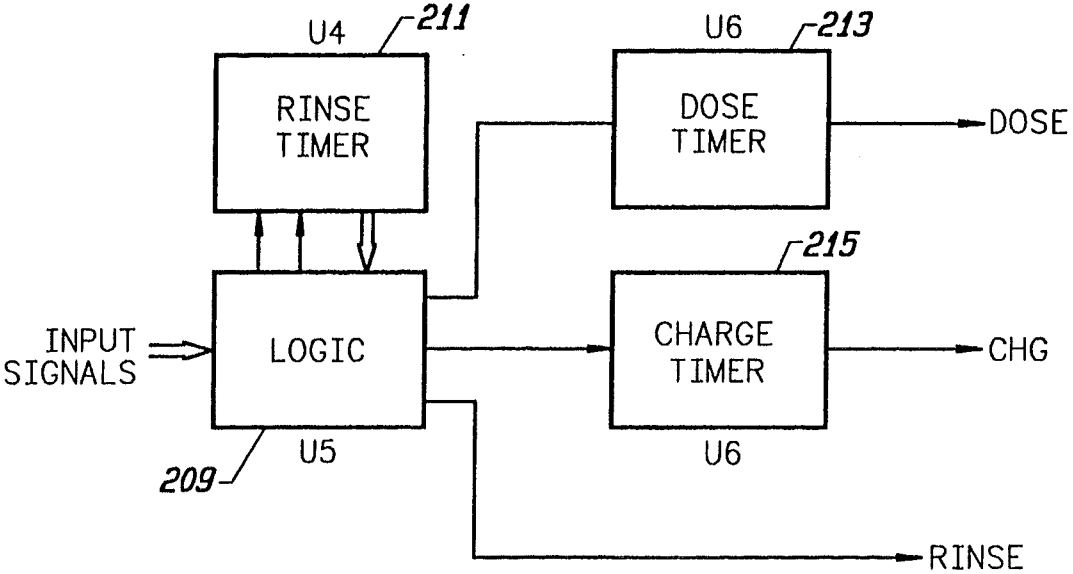
FIG. 3 is an overall block diagram illustrating the dose and charge timing circuits.
Figure 2:
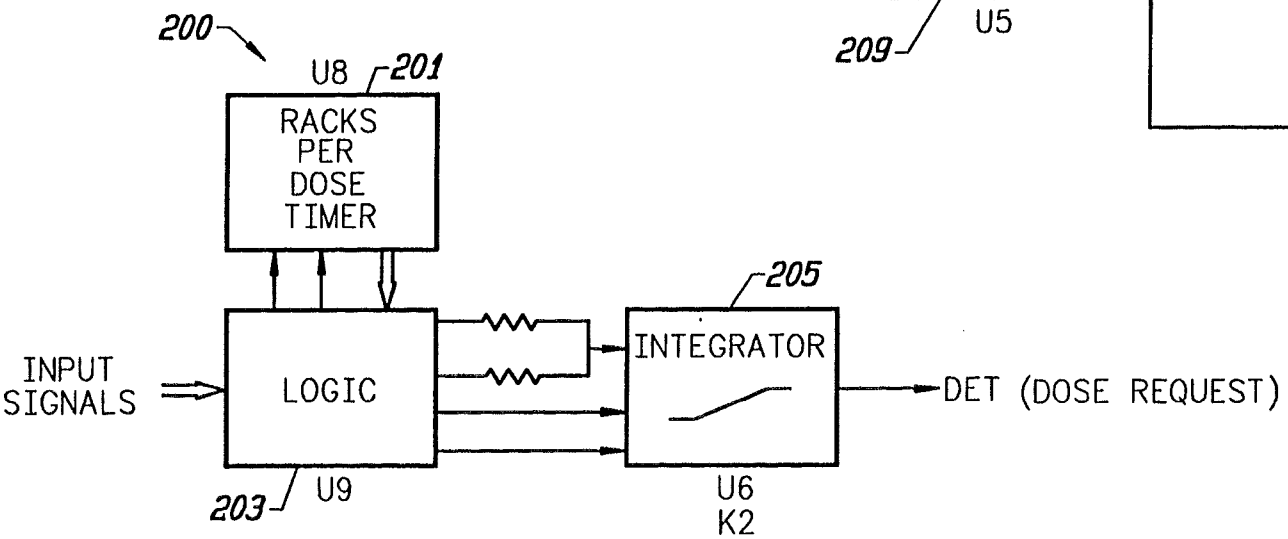
FIG. 2 is an overall block diagram illustrating the dose request circuit.

FIGS. 2 and 3 are overall circuit block diagrams illustrating the major features of the control system. FIG. 2 illustrates the portion of the circuit 200 that determines when a detergent dose is to be supplied. In particular, logic 201 periodically generates a signal DET based on various inputs, including those from racks per dose timer 203, that are summed or integrated in integrator 205. When an appropriate number of cycle signals have been detected, in the case of door machines, or an appropriate amount of time has passed, in the case of conveyor machines, the integrator generates a signal "DET" that ultimately causes the system to generate a detergent dose.

The detergent dose request is generated, in the door mode, after a predetermined number of cycles. By contrast, in the conveyor mode the detergent dose is requested after the passage of a predetermined amount of time. For example, in the door mode the system may request a detergent dose after every three door openings or cycles, while in the conveyor mode the system may request a detergent dose after every 25 or 75 seconds of accumulated rinse times. For the door washer, an initial charge is dispensed when more than 20 seconds of continuous time is detected by the system in one embodiment.

The integrator 205 uses a non-volatile memory that accumulates information from one power-on cycle to the next. By "non-volatile" it is intended to mean herein a memory that retains, for a significant period of time, the rinse cycle count, for example, from one cycle to the next. For example, if a conveyor cycle machine is operated in rinse for 10 seconds, removed from service, and operated in rinse for another 15 seconds, this information will still be accumulated in the integrator 205 and a detergent dose will be generated. Similarly, if a door type machine is place through 2 cycles, powered down, and restarted, the system will accumulate the prior two cycles of information and generate a detergent dose after one additional cycle.

According to a specific embodiment, the DET signal is generated by charging a timing capacitor from a previous voltage to a next level with a programmable current source at a rate set by a resistor. When this voltage level exceeds a threshold value, as determined by a logic output signal, the DET signal is generated. The capacitor is discharged after this time by a signal DSCHG. When power is disconnected from the unit, the capacitor retains its charge.

FIG. 3 is an overall circuit diagram illustrating the timing portion of the system. The system generates a signal DOSE that determines the amount of time detergent is added to the water during normal recharge operations. The system generates a signal CHG to provide an initial charge volume to the system. The signals are generated under the direction of logic 209 based on, among other inputs, a timer 211 that advises the logic of the length of time a rinse has taken. The DOSE signal is generated by dose timer 213 for normal addition of detergent. The CHG signal is generated by charge timer 215 for initial charge of detergent (which will normally occur when the washer is initially charged with rinse water), or when the user manually enters a signal indicating the machine should be charged. Alternatively, an initial charge may occur when a signal X2CHG is generated by a manual request from the user.

Figures 1, 4A:
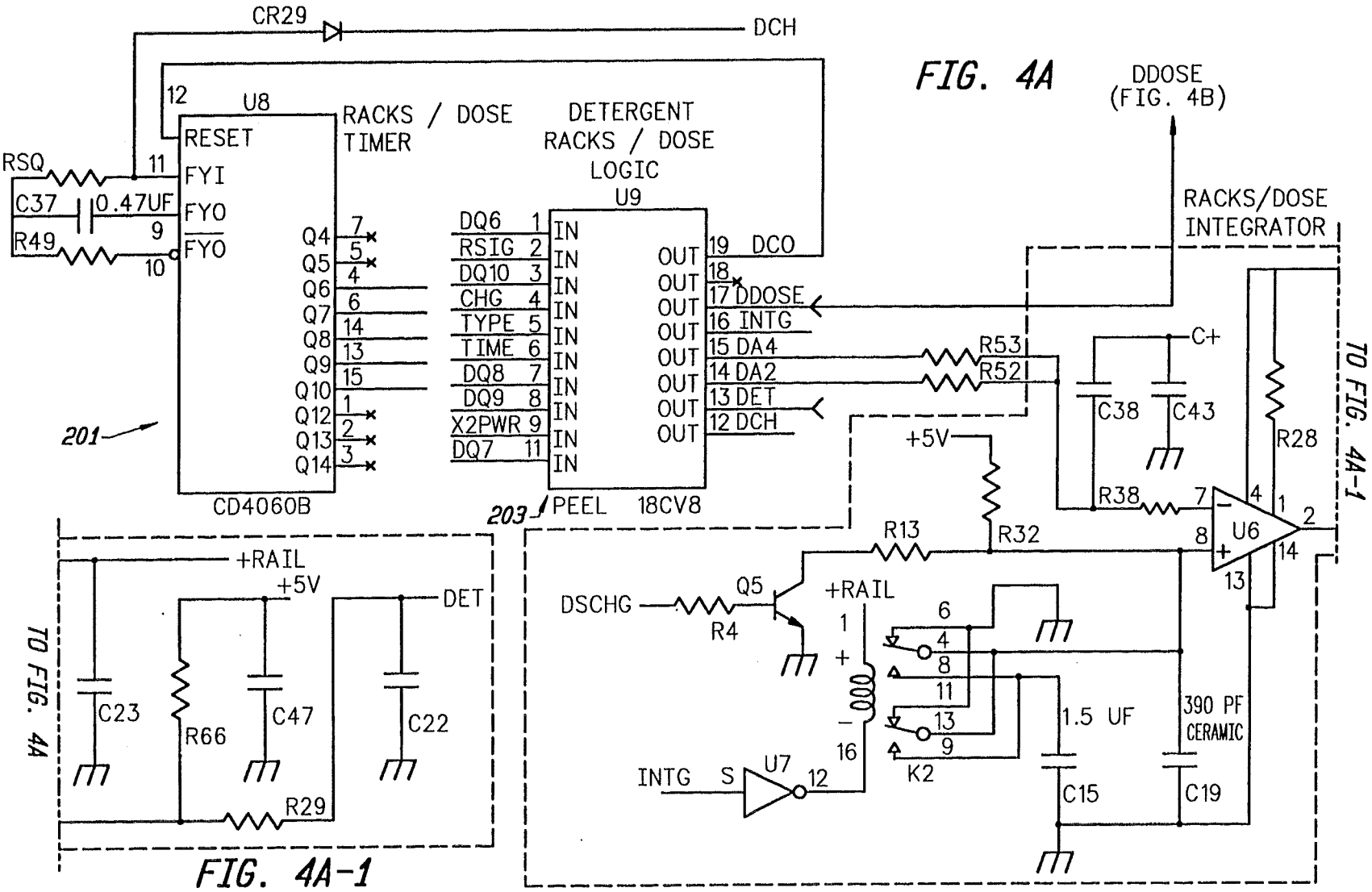
FIGS. 4A to 4E illustrate the circuits used according to one aspect of the invention in greater detail.

FIGS. 4A to 4E illustrate the control circuit in greater detail. FIG. 4A illustrates one preferred circuit for generating the DET signal for initiation of a detergent dose request. As shown, the operations therein take place under the direction of a PLA U9. The PLA generates an integration time signal INTG after a predetermined time (measured based on input from the timer 201) from when a rinse signal is generated by the warewasher, RSIG. INTG drives a relay circuit K2. RSIG is a reduced voltage version of a signal RS that is received directly from the warewasher rinse solenoid power supply line. The relay charges a capacitor C15 for a predetermined time, again as measured by the PLA/-timer. The signal DET is generated, via opamp U6 and resistor R29 when the voltage difference across U6 becomes positive, which will generally occur after three cycles in a door loading machine. The difference in voltage across U6 will be partially set by DA4 and DA2 from the PLA. Through the use of two voltage signals from the PLA for generating a comparison value, it becomes possible to generate any of three different voltage levels. DCH prevents the racks/dose timer from rolling over for long periods, and DDOSE is a delayed dose signal to allow the circuits to settle. DSCHG, generated by the PLA after, for example, DET has been generated, discharges the capacitor to restart the integration of voltage thereon. RCH prevents the rinse times from rolling over.

Figure 4B:
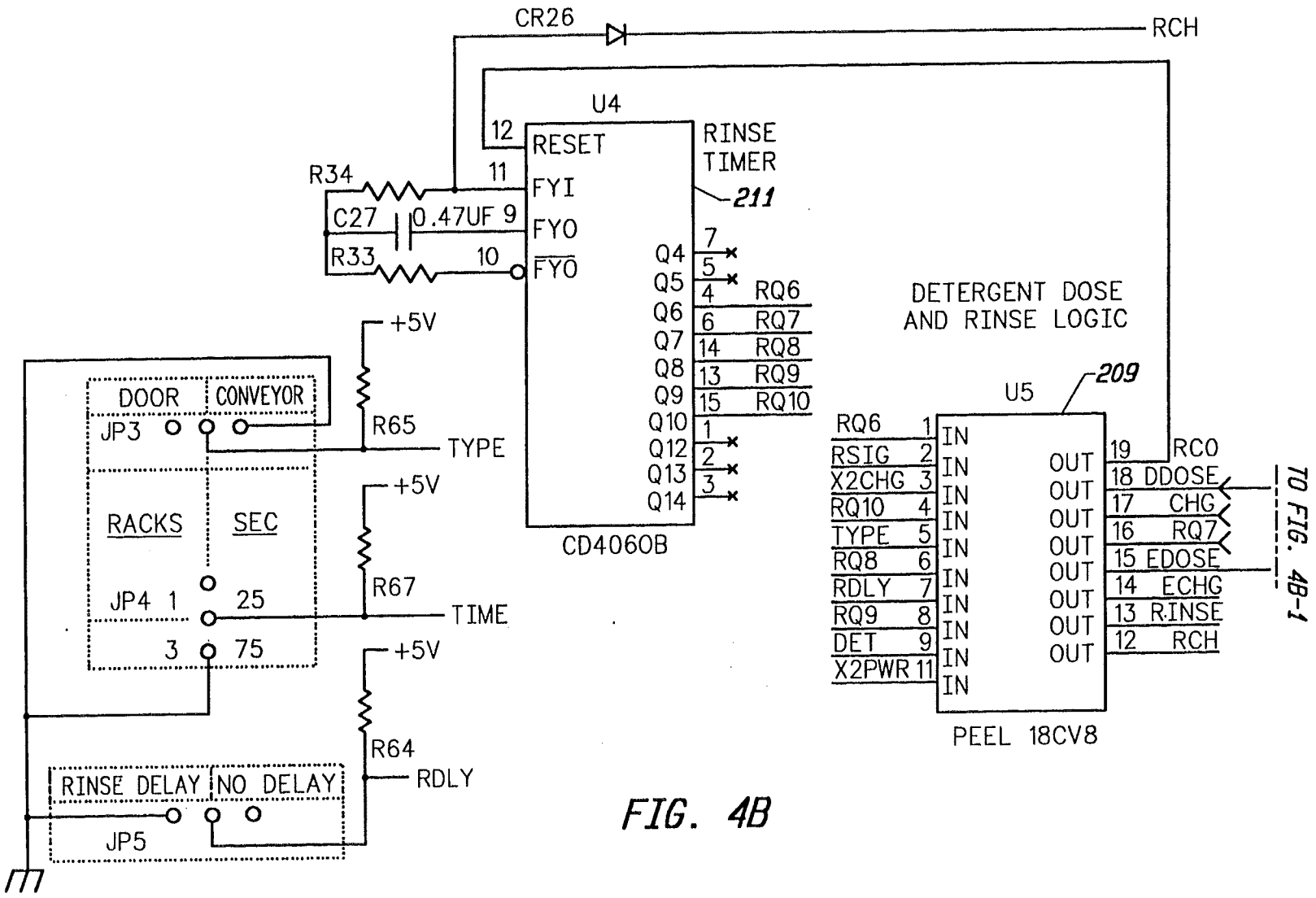
Figures 1, 4B:
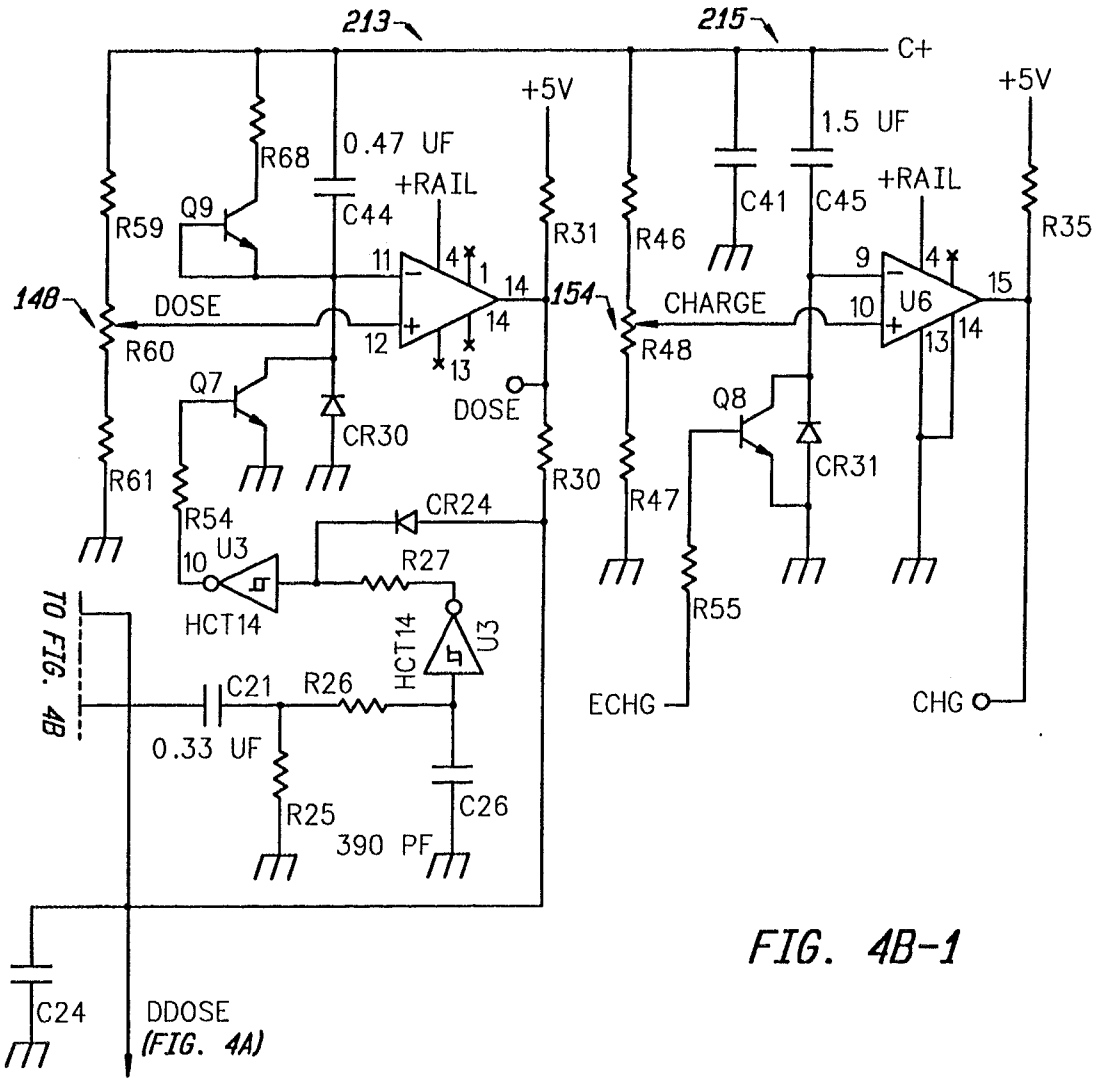

The left portion of FIG. 4B illustrates the switches for setting the machine type, the rack number or time for a detergent dose, and the rinse delay/no delay parameters. As shown, the setting of these switches generates signals TYPE (washer type), TIME (number of racks or time after which a dose is to be generated), and RDLY (time for a rinse delay) that are used elsewhere by the PLAs.

The remaining portion of FIG. 4B illustrates the portion of the circuit that generates the DOSE and CHG signals that control the dose of detergent addition during normal recharge, and the amount of initial charge respectively. Importantly, (unlike conventional RC timing circuits) the circuits may each be adjusted by way of a potentiometer (R48 and R60) such that they may be trimmed back by the user while a dose is being generated until they stop the flow of detergent, without changing the rate of change of time at which the circuit is approaching its cut-off point. Accordingly, the user may, for example, start a rinse dose for an initial charge, and after the desired time has passed, the user trims back potentiometer R48 until the detergent pump stops.

EDOSE is generated by PLA 209 for a controlled amount of time based on input from timer 211 after being ANDd in the PLA with the signal RSIG, which ensures that spurious charges are not generated. The EDOSE signal charges C44 (in a negative sense) at until input 11 to opamp 213 is lower than the voltage on input 12. The voltage at input 12 is set by potentiometer 148. Since this voltage does not impact the rate of charge of the capacitor in the manner of a conventional RC circuit, the user may "back up" the voltage on pin 12 with the resistor 148 to a desired set point, which will be detected when the detergent pump shuts off in this case. The trip point will not change as R is varied in the circuit. The circuit for generation of the initial charge signal CHG operates similarly and independently based on X2CHG and X2PWR, except that CHG discharges the charge on C44 with DDOSE and the potentiometer.

Figure 4C:
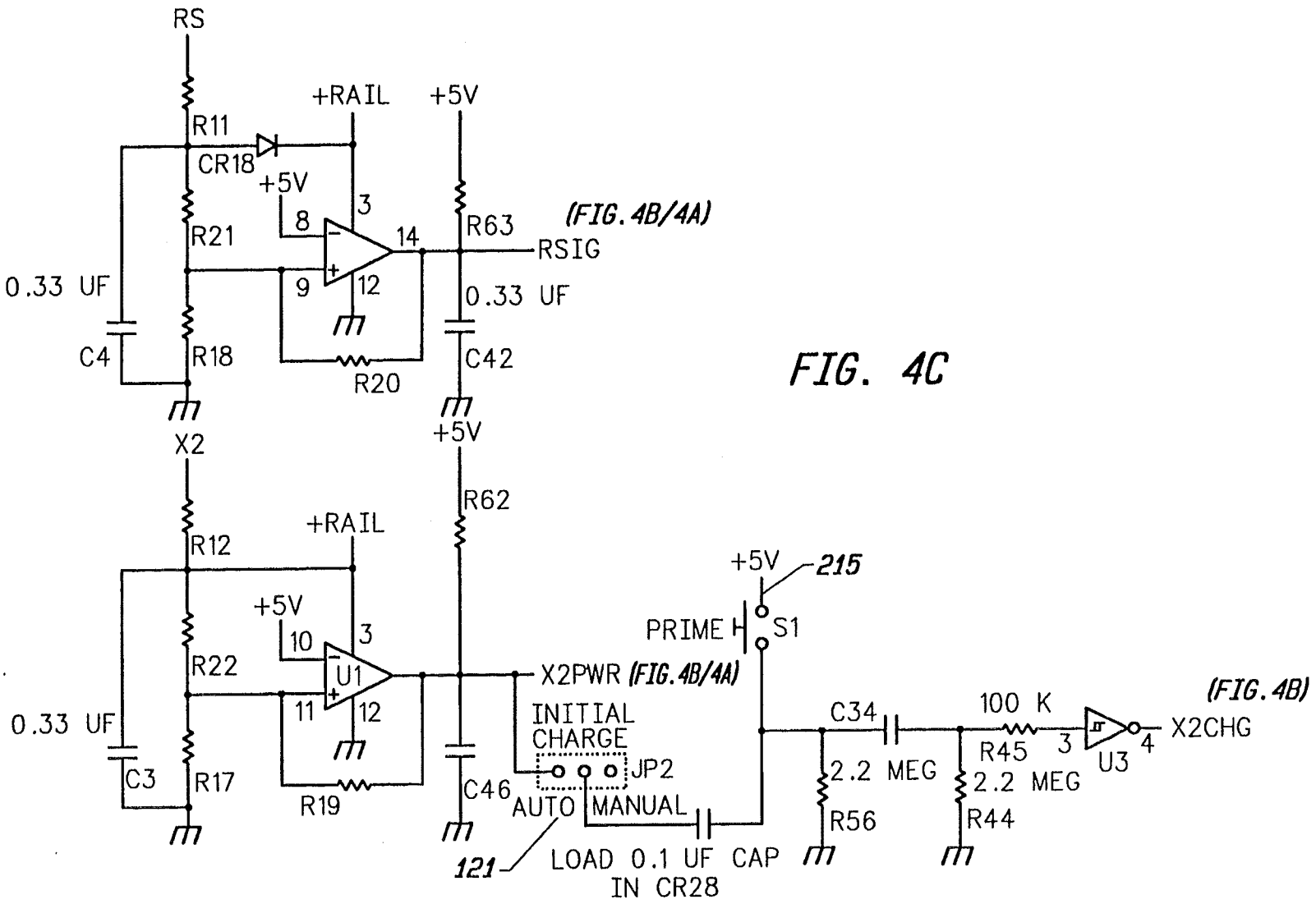

FIG. 4C illustrates a circuit for generating a signal RSIG indicating that the washer is rinsing at an appropriate voltage level for the PLAs based on an input RS from the warewasher. The lower portion of FIG. 4C illustrates circuits for generation of an initial charge signal based on either input from a manual switch 215 or generation of a power on signal X2. These are selected with the switch 121.

Figure 4D:
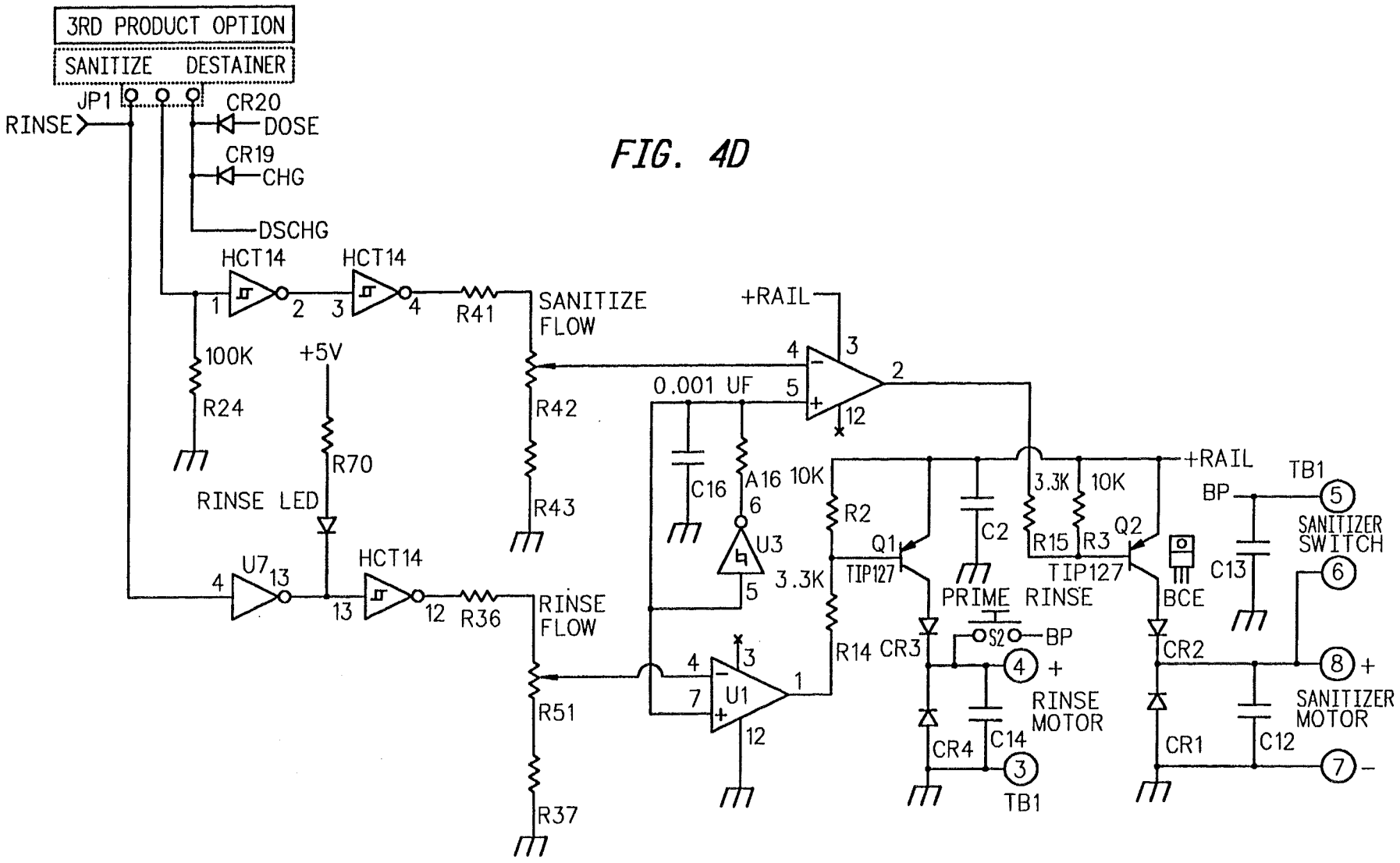

FIG. 4D illustrates a circuit for distribution of power for the rinse pump motor, the sanitizer motor and/or a sanitizer switch, which will be dictated by the DOSE, CHG, and RINSE signals.

Figure 4E:
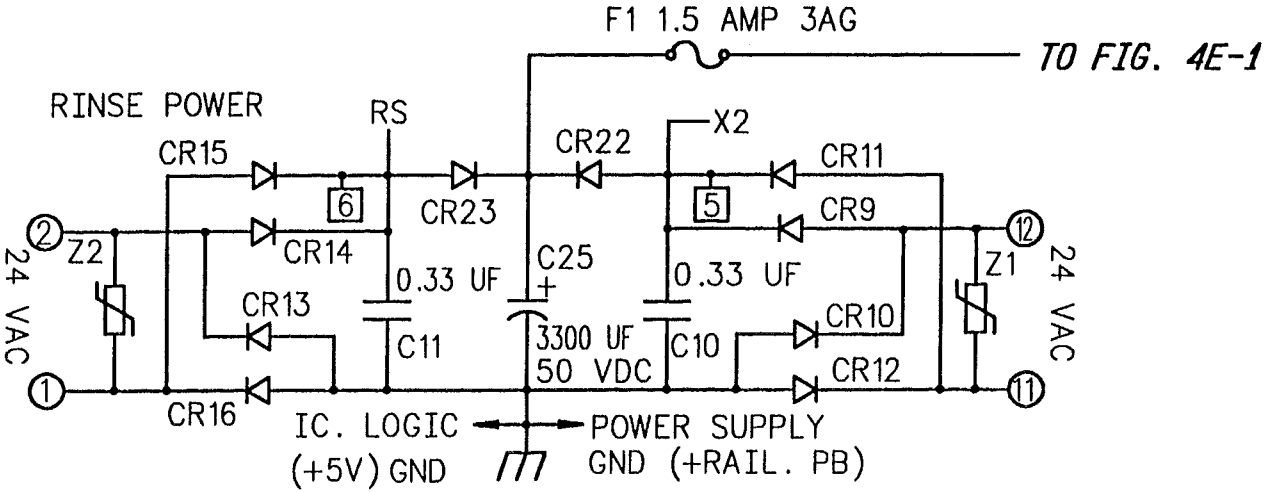
Figures 1, 4E:
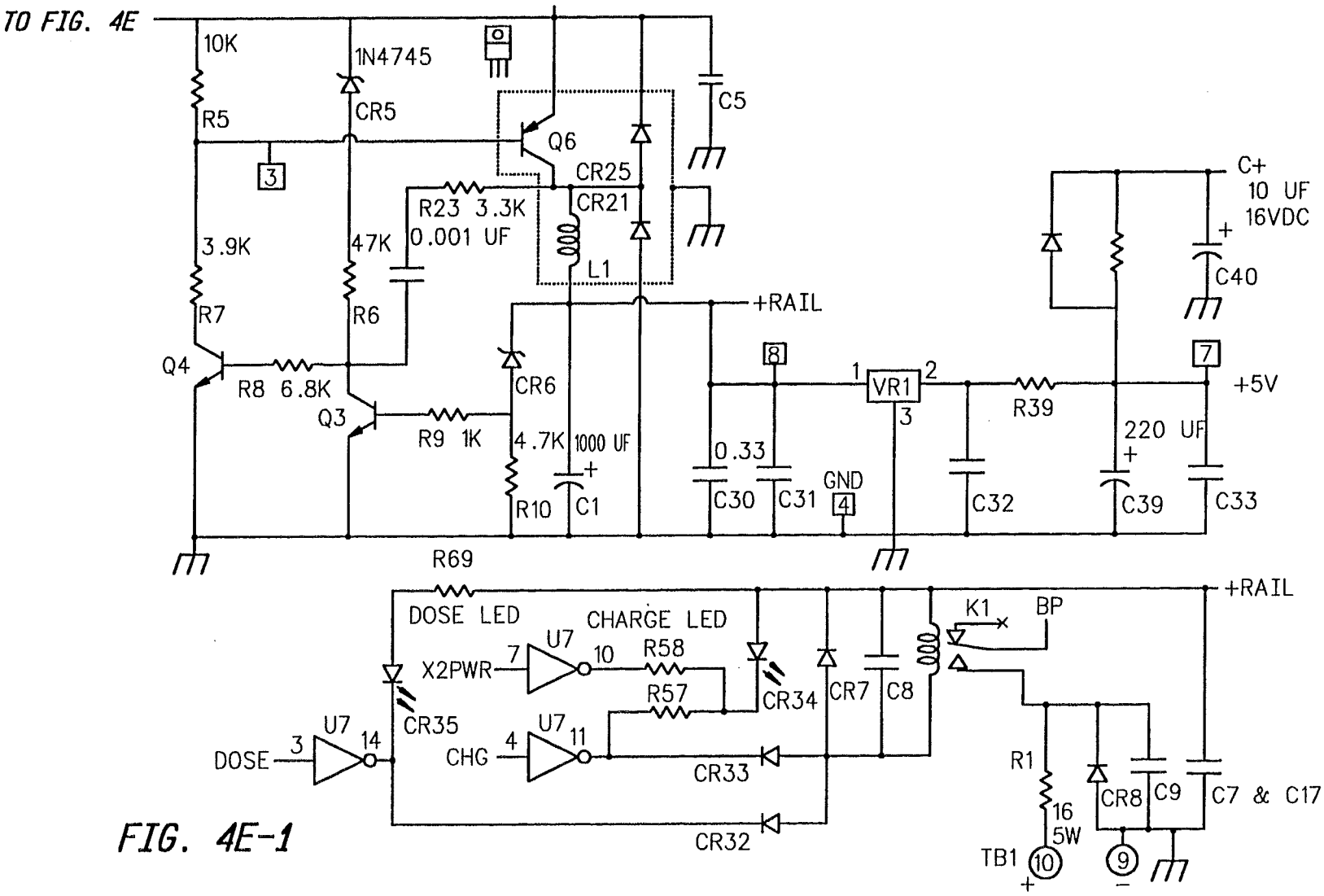

FIG. 4E illustrates circuits for generation of power such as +5 v., a stabilized 5 v. power level C+, and 24 v. power for operation of the motors, as well as a rail voltage based on DOSE. A single transformer circuit is coupled to the rinse power to supply the power needs of the system.

Without wishing to be bound to any particular implementation of the invention, Table 1 provides an example PLA program listing for a PLA 203 used in the generation of the DET signal. Similarly, Table 2 provides a PLA program listing for a PLA 209 used in generation of the DOSE and CHG signals.

TABLE 1

PLA Program Listing

```
Name      D381100A;
Partno    16L8;
Date      12/27/91;
Revision  00;
Designer  David R. Howland;
Company   Nova Controls;
Assembly  51-03750-00;
Location  U9;
Device    P16V8;
/*                                                                    */
/*    Provides Logic for Detergent feed circuit. Design              */
/*  uses an up counter, option jumpers, and logic signals to         */
/*  initiate an external signal called "DET" which is sent to        */
/*  another logic device where it is qualified and generates a       */
/*  signal called "EDOSE" which feeds to a timer where a             */
/*  signal called "DOSE" is generated and a delayed signal           */
/*  called "DDOSE" is sent back to this logic for                    */
/*  verification purposes. "DET" is generated in two ways.           */
/*  For door machines set to one rack and for conveyor               */
/*  machines set to the minimum time, only the counter is            */
/*  used to generate the signal "DET". For higher conveyor           */
/*  times or for 3 racks in door, the power fail                     */
/*  protected timing cap is used as a protected storage              */
/*  device to cause "DET" to trigger only on the third               */
/*  time th counter advances from zero into its appropriate          */
/*  binary count. When the counter reaches a specific binary         */
/*  value the timing cap is integrated from where it was to          */
/*  its next level via a programmable current source                 */
/*  (LP365AN). When this level exceeds a threshold as                */
/*  controlled by "DA4-DA2" the signal "DET" will be                 */
/*  generated. The timing cap may be discharged by                   */
/*  "DSCHG" during an Integration cycle.                             */
/*                                                                    */
/** Inputs **/
Pin    1 = DQ6      ; /*  Detergent Counter Least Significant bit   */
Pin    2 = RSIG     ; /*  Rinse Signal goes low for Rinse           */
Pin    3 = DQ10     ; /*  Detergent Counter Most Significant bit    */
Pin    4 = CHG      ; /*  Charge Timer is operating when active     */
Pin    5 = TYPE     ; /*  Door or Conveyor Machine                  */
Pin    6 = TIME     ; /*  Time Long between Racks or Every Rack     */
Pin    7 = DQ8      ; /*  Detergent Counter                         */
Pin    8 = DQ9      ; /*  Detergent Counter                         */
Pin    9 = X2PWR    ; /*  X2 Power                                  */
Pin   11 = DQ7      ; /*  Detergent Counter bit 7                   */
Pin   13 = DET      ; /*  Deteregent does request signal in         */
Pin   17 = DDOSE    ; /*  Delayed Dose Signal in                    */
/** Outputs **/
Pin   12 = !DCH     ; /*  Detergent Counter Hold (pause)            */
Pin   14 = !DA2     ; /*  D/A low bit out                           */
Pin   15 = !DA4     ; /*  D/A high bit out                          */
Pin   16 = INTG     ; /*  Integrate the Timing cap to next level    */
Pin   19 = DC0      ; /*  Detergent Counter Reset (zero)            */
/** Logic Equations **/
$DEFINE * &
```

TABLE 1-continued

```
$DEFINE + #
DCH     =  TYPE * DQ10 * DQ9 * DQ8
        +  CHG * DQ9
        +  !RSIG * DQ7 ;
DA2     =  !CHG * RSIG * ?DQ10 * !DQ9 * !DQ8 * !DQ7 *
           !DQ6 * TIME ;
DA4     =  !CHG * RSIG * !DQ10 * !DQ9 * !DQ8 * !DQ7 *
           !DQ6 ;
INTG    =  RSIG * !DQ10 * !DQ9 * DQ* * !DQ7 * DQ6
        +  RSIG * !DQ10 * !DQ9 * DQ8 * !DQ7 * !DQ6
        +  RSIG * !DQ10 * !DQ9 * !DQ8 * DQ7 * DQ6
        +  RSIG * !DQ10 * !DQ9 * !DQ8 * DQ7 * !DQ6
        +  RSIG * !DQ10 * !DQ9 * !DQ8 * !DQ7 * DQ6
        +  RSIG * !DQ10 * !DQ9 * !DQ8 * !DQ7 * !DQ6
        *  CHG ;
DC0     =  TYPE * !RSIG ;
```

(c) Copyright, Nova Controls

TABLE 2

PLA Program Listing

```
Name      D381000A;
Partno    16L8;
Date      12/27/91;
Revision  00;
Designer  David R. Howland;
Company   Nova Controls;
Assembly  51-03750-00;
Location  U4;
Device    P16V8;
/*                                                          */
/*   Provides Rinse Logic and Provides Detergent feed       */
/*  Logic for Dose and Charge. Also shares signals with     */
/*  2nd PEEL in Design called Racks per Dose Logic as a     */
/*  part of the detergent replenishment system.             */
/*                                                          */
/*  Rinse Logic uses the Rinse Counter and Jumpers to       */
/*  determine when the Rinse will feed. In "Door" a Rinse   */
/*  Limit Timer will cause the Rinse feeding to terminate   */
/*  after 20 seconds of run. In Rinse Delay, the Rinse will */
/*  not begin feeding for a short delay time. In all cases
/*  after the Primary Rinse timing is complete (qualified and */
/*  delayed if enabled) the Rinse Counter will hold and     */
/*  not "Roll Over".                                        */
/*                                                          */
/*  Detergent feeding can be initiated from the Dose Timer  */
/*  which is started from the "DET" signal, and from the    */
/*  Charge Timer which is started by the Rinse Limit timer  */
/*  or "X2CHG".                                             */
/*                                                          */
/*  Allowable Target Device Types: 16L8                     */
/*                                                          */
/** Inputs **/
Pin    1 = RQ6      ; /*  Rinse Counter Least              */
                          Significant bit
Pin    2 = RSIG     ; /*  Rinse Signal                     */
Pin    3 = !X2CHG   ; /*  Second Transformer Power &       */
                          Prime Switch
Pin    4 = RQ10     ; /*  Rinse Counter Most               */
                          Significant bit
Pin    5 = TYPE     ; /*  Door or Conveyor Machine         */
Pin    6 = RQ8      ; /*  Rinse Counter                    */
Pin    7 = RDLY     ; /*  Rinse Delay Jumper               */
Pin    8 = RQ9      ; /*  Rinse Counter                    */
Pin    9 = DET      ; /*  Dose Request                     */
Pin   11 = X2PWR    ; /*  X2 Power                         */
Pin   16 = RQ7      ; /*  Rinse Counter bit 7              */
Pin   17 = CHG      ; /*  Input from Charge timer          */
Pin   18 = DDOSE    ; /*  Input from Dose timer            */
/** Outputs **/
Pin   12 = !RCH     ; /*  Rinse Counter Hold (Pause)       */
Pin   13 = RINSE    ; /*  Rinse Feed output                */
Pin   14 = ECHG     ; /*  Enable (Start) Charge Timer      */
Pin   15 = EDOSE    ; /*  Enable (Start) Dose Timer        */
Pin   19 = RC0      ; /*  Rinse Counter Reset (Zero)       */
/** Logic Equations **/
$DEFINE * &
$DEFINE + #
ECHG    =  X2CHG * !TYPE
        +  X2CHG * TYPE * !RQ10
```

TABLE 2-continued

```
        +  RSIG * TYPE * RQ10 * !RQ9 * !RQ8 *
           !RQ7 * !CHG ;
RCH     =  RQ10 * RQ9 * RQ8 ;
RC0     =  !RSIG ;
EDOSE   =  RSIG * DET ;
RINSE   =  !CHG * RSIG * TYPE * RDLY *
           !RQ10 * RQ9 * RQ8 * RQ7
        +  !CHG * RSIG * TYPE * RDLY *
           !RQ10 * RQ9 * RQ8 * !RQ7
        +  !CHG * RSIG * TYPE * RDLY *
           !RQ10 * RQ9 * !RQ8 * RQ7
        +  !CHG * RSIG * TYPE * RDLY *
           !RQ10 * RQ9 * !RQ8 * !RQ7
        +  !CHG * RSIG * TYPE * RDLY *
           !RQ10 * !RQ9 * RQ8 * RQ7
        +  !CHG * RSIG * TYPE * RDLY *
           !RQ10 * !RQ9 * RQ8 * !RQ7
        +  !CHG * RSIG * TYPE * RDLY *
           !RQ10 * !RQ9 * !RQ8 * RQ7
        +  !CHG * RSIG * TYPE * RDLY *
           !RQ10 * !RQ9 * !RQ8 * !RQ7
        +  !CHG * RSIG * TYPE * !RDLY *
           RQ10 * !RQ9 * !RQ8 * RQ7
        +  !CHG * RSIG * TYPE * !RDLY *
           RQ10 * !RQ9 * !RQ8 * !RQ7
        +  !CHG * RSIG * TYPE * !RDLY *
           !RQ10 * RQ9 * RQ8 * RQ7
        +  !CHG * RSIG * TYPE * !RDLY *
           !RQ10 * RQ9 * RQ8 * !RQ7
        +  !CHG * RSIG * TYPE * !RDLY *
           !RQ10 * RQ9 * !RQ8 * RQ7
        +  !CHG * RSIG * TYPE * !RDLY *
           !RQ10 * RQ9 * !RQ8 * !RQ7
        +  !CHG * RSIG * TYPE * !RDLY *
           !RQ10 * !RQ9 * RQ8 * RQ7
        +  !CHG * RSIG * TYPE * !RDLY *
           !RQ10 * !RQ9 * RQ8 * !RQ7
        +  RSIG * !TYPE ;
```

II. Timing Adjustment Circuit

Figure 5B:
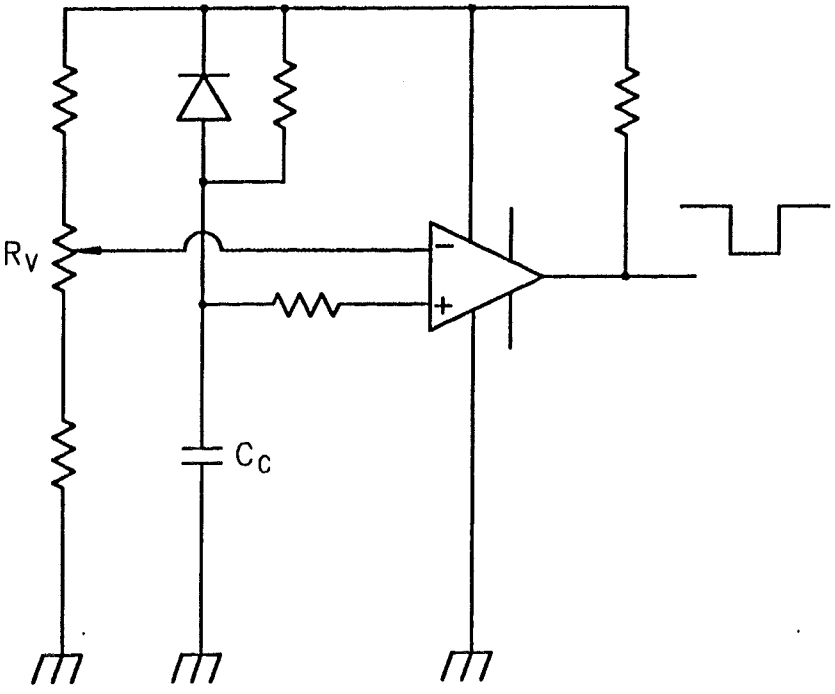
FIGS. 5A to 5B illustrate alternative dose timing control circuits in greater detail.
Figure 5A:
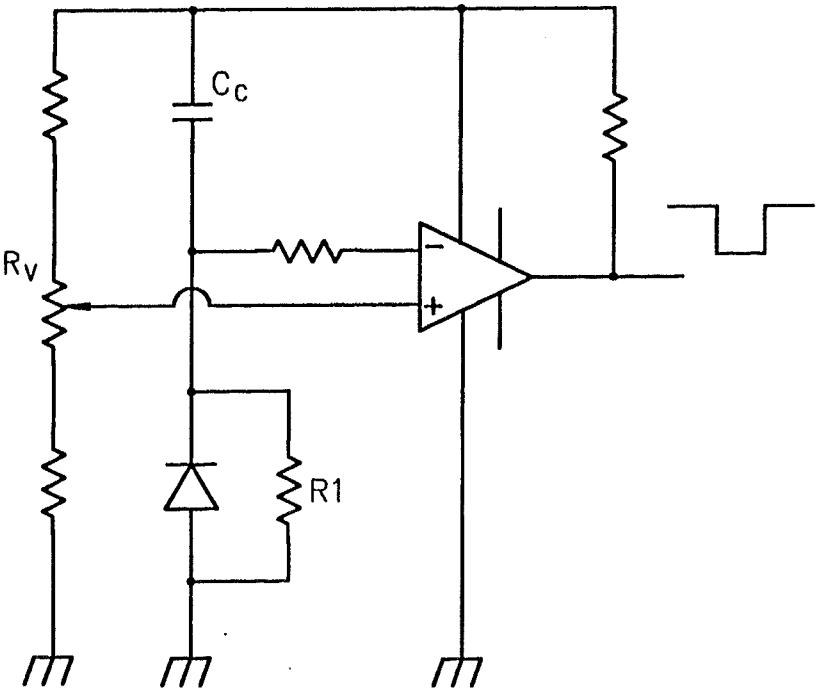

FIGS. 5A to 5B illustrate alternative set-circuits for dose time for both the initial charge dose and the recharge dose. Such circuits will have broader application to other areas where it is desired to set a trip point, but where it is desired that the circuit be progressing to the trip point at a constant rate as it is adjusted. In each case the circuit charges the control capacitor Cc at a rate that is independent of the set point that is set with a potentiometer Rv. In each case, the potentiometer is setting the voltage at one input of an opamp (or comparator), while the other input voltage to the opamp is set by the amount of charge stored on a capacitor. FIG. 5B illustrates that the inputs and coupled circuits to the opamp and polarity of charge to be applied to the capacitor may be reversed.

III. Digital Memory

Figure 6:
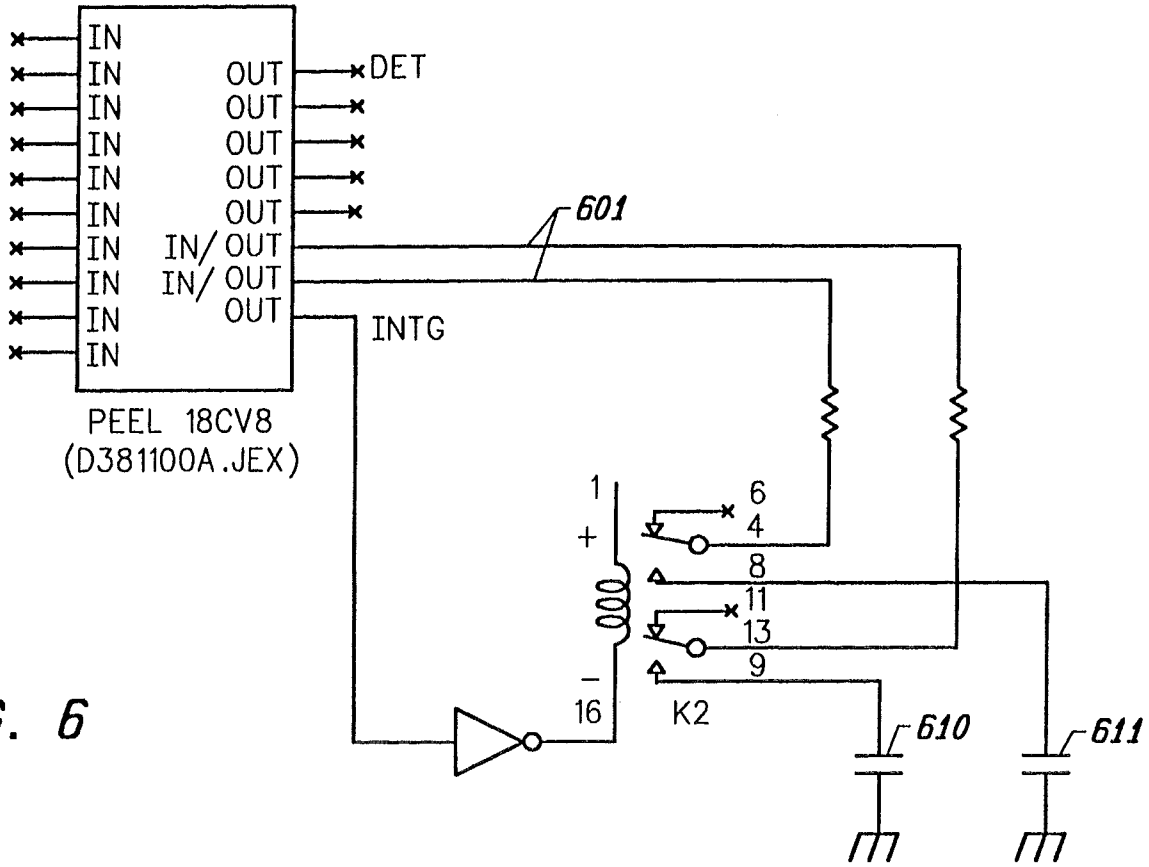
FIG. 6 illustrates an alternative embodiment of a circuit for generation of a detergent request signal.

FIG. 6 illustrates an alternative circuit for generation of the DET signal (detergent request). During power ups, the PLA "reads" the charge on the two capacitors via the IN/OUT pins. It then increments the charge thereon using the IN/OUT pins by the PLA to represent a next binary value. For example, when both have 0 charge, the capacitors are read and charged to act as a binary counter to "01," then "10," then "11." In this case the changes in the capacitor voltage are monitored at IN/OUT pins 601. When the count reaches a preset level, it is detected by the PLA logic, which generates an appropriate DET signal. Again, the capacitor voltages will be largely independent of whether the power is supplied to the system, which will have particular importance in door type machines as a non-volatile memory.

IV. Installation/Operation

To utilize the device in a warewashing system, for a door type warewasher, the washer rinse solenoid power is connected to the "rinse" solenoid transformer at "RS" in the above drawings. The various jumpers are preferably set such that the washer type is on "door," the product type is "sanitizer," the activation delay is set to "no delay," the number of racks per dose is set to 3, and the initial charge is set to automatic. The detergent dose amount is set to maximum and the detergent initial charge setting is placed at a midpoint.

The warewasher is then powered and placed in a rinse cycle for setup. The rinse pump will begin to rinse and, accordingly, the detergent pump will turn on. The dose/recharge light will be on. The amount of detergent that has been dispensed is measured, and the detergent dose amount potentiometer is adjusted downwards until the detergent pump stops at the desired amount of detergent or at the estimated time that is desired. In general, such pumps will dispense about 0.1 oz of material every second.

After a total elapsed rinse power time of about 20 seconds the rinse pump will stop. The initial charge system will then run the detergent pump. The same procedure is conducted to adjust the detergent initial charge potentiometer until the initial charge amount is dispensed by the detergent pump.

In conveyor type systems, the same general procedure is conducted, except that the system is also connected to an additional source of washer power, such as the washer heater, that is turned on at the time of initial power up of the washer. Alternatively, the system may be operated with the initial charge jumper set to manual, in which case the prime button is used for initial charging of the washer.

The above description is illustrative and not restrictive. Many variations of the invention will become apparent to those of skill in the art upon review of this disclosure. Merely by way of example certain systems and methods disclosed herein will have application in systems other than warewashing equipment. By way of further example, operations herein have been described by way of several discrete devices in many cases, but such operations could readily be performed in some embodiments with a single microprocessor or microcontroller. The scope of the invention should, therefore, be determined not with reference to the above description, but instead should be determined with reference to the appended claims along with their full scope of equivalents.

What is claimed is:

1. In a batch wash system having both a wash cycle and a rinse cycle and a signal for activating said rinse cycle for intake of rinse water, a detergent supply control system comprising:

rinse signal detection means, said rinse signal detection means providing an input to said control system and coupled to non-volatile rinse counting means, said counting means adapted to generate a signal for dispensing a detergent dose when said counting means reaches a selected limit.

2. A control system as recited in claim 1 wherein said selected limit is selected from a plurality of cycle number selections with a switch.

3. A control system as recited in claim 1 further comprising a conveyor power inlet means, and means for switching said control system between batch and conveyor operation, said control means adapted to receive power from said conveyor power inlet means when said means for switching is set to conveyor operation.

4. A control system as recited in claim 1 wherein when said rinse signal is not active, said counting means retains a value representative of a number of cycles that were performed before said rinse power became inactive.

5. A control system as recited in claim 4 wherein said non-volatile counting means comprises a capacitor for storing an accumulated amount of charge related to said number of cycles performed.

6. A control system as recited in claim 1 further comprising a means for adjusting a dose of detergent to be added during a rinse cycle.

7. A control system as recited in claim 1 further comprising a means for adjusting an initial dose of detergent to be added during an initial water charge.

8. A control system as recited in claim 1 further comprising:

means for adjusting a dose of detergent to be added during a rinse cycle; and means for adjusting a dose of detergent to be added during an initial water charge.

9. A control system as recited in claim 6, 7 or 8 wherein said means for adjusting both comprise a potentiometer, a charge storage capacitor and a comparison means having a first and a second input, said potentiometer coupled to said first input of said comparison means, and said storage capacitor coupled to said second input of said comparison means, whereby said potentiometer may be adjusted to vary a voltage for setting a trip point for adjusting said dose without significantly varying a rate at which said capacitor is charged, and said dose is completed when the voltage in said capacitor exceeds the voltage in said potentiometer.

10. A control system as recited in claim 9 wherein said potentiometer is adapted to adjust said amount of charge to be stored on said capacitor for controlling said dose and is substantially independent of the rate at which said capacitor is to be charged.

11. A control system as recited in claim 1 wherein said control means is adapted to dispense a detergent dose in a given cycle for a limited Lime, and further comprising means for dispensing an initial dose when said limited time is reached.

12. A control system as recited in claim 1 wherein said non-volatile counting means comprises:

programmable logic means having a plurality of input/output terminals;

a plurality of capacitance means separately coupled to each of said input/output terminals, said capacitance means retaining their charge from one power on cycle to the next, said programmable logic means programmed to alternately:

read a voltage on each of said capacitance means, said voltage being a high or low value, each of said capacitive means representing one bit of a binary value, and based on a pattern of high and low voltages on said capacitance means, charge or discharge selected capacitance means to increment said binary value.

13. A control system as recited in claim 12 wherein said programmable logic means comprises a programmable logic device.

14. A control system for dispensing chemicals for use in a warewashing device, said warewashing device having a power supply providing a first power source for activating a wash cycle and a second power source for activating a rinse cycle during which rinse water is injected into the warewashing device, said control system comprising:

means for detecting said second power source; and counting means coupled to said means for detecting said second power source, said counting means inducing a signal for dispensing a chemical dose when said counting means reaches a selected threshold.

15. A control system as recited in claim 14 further comprising a conveyor power inlet means and means for switching said control system between batch and conveyor operation, said control means adapted to receive power from said conveyor power inlet means when said means for switching is set to conveyor operation.

16. A control system as recited in claim 14 wherein said counting means is a non-volatile counting means such that when said rinse power is not active, said counting means retains a value representative of a number of cycles that were performed before said rinse power became inactive.

17. A control system as recited in claim 14 further comprising a means for adjusting said dose of chemical to be dispensed, said means for adjusting said dose of chemical comprising a potentiometer, a charge storage capacitor and a comparison means having a first and a second input, said potentiometer coupled to said first input of said comparison means, and said storage capacitor coupled to said second input of said comparison means, whereby said potentiometer may be adjusted to vary a voltage for setting a trip point for adjusting said dose without significantly varying a rate at which said capacitor is charged, and said dose is completed when the voltage in said capacitor exceeds the voltage in said potentiometer.

18. In a warewash system having both a wash cycle and a rinse cycle and a signal for activating said rinse cycle, a warewash control system for dispensing materials, said warewash control system comprising:

a power supply from said warewash system;

a single transformer for converting power from said power supply to at least one voltage for use in said control system; and a control circuit for dispensing a plurality of materials to said warewash system, said control circuit powered from said transformer means and wherein said control circuit comprises, a rinse signal detection means for detecting the presence of said signal for activating said rinse cycle, and a non-volatile rinse counting means coupled to said rinse signal detection means, said counting means adapted to generate a signal for dispensing said materials when said counting means reaches a selected limit.

* * * * *